US005397968A

United States Patent [19]

Ito et al.

[11] Patent Number: 5,397,968

[45] Date of Patent: Mar. 14, 1995

[54] DEFLECTION YOKE

[75] Inventors: Masaaki Ito; Tomohiro Akaki, both of Iwai, Japan

[73] Assignee: Victor Company of Japan, Ltd., Yokohama, Japan

[21] Appl. No.: 122,247

[22] Filed: Sep. 16, 1993

[30] Foreign Application Priority Data

Sep. 18, 1992 [JP] Japan ..... 4-275102
Nov. 27, 1992 [JP] Japan ..... 4-341627
Feb. 22, 1993 [JP] Japan ..... 5-054644

[51] Int. Cl.[6] ..... G09G 1/28; G09G 1/04; H01J 29/56

[52] U.S. Cl. ..... 315/368.28; 315/370; 315/399

[58] Field of Search ..... 315/368.11, 368.25, 315/368.28, 370, 399

[56] References Cited

U.S. PATENT DOCUMENTS 5,008,600 4/1991 Hashimoto et al. ..... 315/370
5,079,486 1/1992 Honda et al. ..... 315/371
5,142,205 8/1992 Yabase et al. ..... 315/368.26
5,260,627 11/1993 Yokota et al. ..... 315/400

FOREIGN PATENT DOCUMENTS 64-84549 3/1989 Japan .
1-225045 9/1989 Japan .

*Primary Examiner*—Gregory C. Issing
*Attorney, Agent, or Firm*—Michael N. Meller

[57] ABSTRACT

Deflection yoke of self-convergence system for deflecting electron beams of a color picture tube, has a pair of saddle type horizontal deflection coils and a pair of saddle type vertical deflection coils of first and second coils connected in series each other, a winding of each of the first and the second coils has a start, a finish and a tap provided between the start and the finish, the deflection yoke further has a diode block composed of diodes connected in parallel and reversed polarity each other. The deflection yoke features that the diode block is connected between the start and the tap of the respective first and second coils, or between the taps of the respective first and second coils, or between the start of the first coil and the start of the second coil, so that misconvergence of the electron beams is minimized. In order to compensate a resistance increase of the vertical deflection coils when temperature thereof rises, a temperature compensation circuit may further be connected in series to the vertical deflection coils.

12 Claims, 8 Drawing Sheets

DEFLECTION YOKE

BACKGROUND OF THE INVENTION

1. Field of the Invention

The present invention .relates to a deflection yoke of a self-convergence system, which is fitted to an in-line type color-picture tube, and particularly related to providing a deflection yoke capable of correcting an inverted pattern of cross misconvergence easily.

2. Description of Prior Art

The deflection yoke of a self-convergence system has been employed as one method to provide good convergence of three electron beams emitted from three electron guns on the screen of an image display using a three-electron gun, in-line color-picture tube.

This type of deflection yoke is designed to obtain good beam convergence by forming horizontal- and vertical-deflection magnetic fields into a strong pincushion shape and a strong barrel shape, respectively, by using saddle-type horizontal deflection coils and saddle-type vertical deflection coils.

However, since the deflection angle may become as large as approximately 90 degrees on the screen of a color-picture tube, the above-mentioned magnetic field distribution originally designed to provide good convergence generates distortions in the shapes of the pincushion and barrel in the upper and lower rasters of the screen, and therefore cannot be put into practical use. On the other hand, correction of these raster distortions introduces cross misconvergenee as shown in FIG. 5 and FIG. 6, leading to the same problem. Thus, it has been very difficult to simultaneously satisfy the requirements of correcting the distortions of the upper and lower rasters and obtaining good convergence. In order to solve the aforementioned problem, a method which conventionally employs a saturable reactor or the like is used in the deflection circuit. Although this method can almost completely eliminate cross misconvergence, it generates an "inverted pattern of cross misconvergence" such that negative and positive cross misconvergences occur respectively in the peripheral regions (a) and middle regions (b) of the screen, as shown in FIG. 7, giving no satisfactory result for displays requiring high precision.

In addition, when this method is applied to flat-face picture tubes with a small degree of screen curvature, it has sometimes been a problem even for general purpose tubes not requiring high precision, because the above-mentioned inverted pattern is emphasized more.

Furthermore, the conventional practice of correcting the inverted pattern has relied on the method where each deflection yoke is corrected by manually adding magnetic pieces or the like one by one, which results in low production efficiency.

The inverted pattern of FIG. 7 reveals that, with the conventional method, the vertical deflection magnetic field shifts toward the above pincushion type magnetic field in the middle region (b) of the screen and toward the above barrel-type magnetic field in the peripheral region (a) of the screen compared with the best magnetic field distribution an ideal magnetic field distribution simultaneously satisfying both the distortion correction of the upper and lower rasters, and convergence.

SUMMARY OF THE INVENTION

Accordingly, it is a general object of the present invention to provide an improved deflection yoke, in which aforementioned problems and difficulties have been overcome.

Another and specific object of the present invention is to provide an improved deflection yoke of self-convergence system for deflecting electron beams of a color picture tube, the deflection yoke has a pair of saddle type horizontal deflection coils and a pair of saddle type vertical deflection coils of first and second coils connected in series with each other, a winding of each of the first and the second coils has a start, a finish and a tap provided between the start and the finish, the deflection yoke further has a diode block composed of diodes connected in parallel and reversed polarity to each other. The deflection yoke features that the diode block is connected between the start and the tap of the respective first and second coils, or between the taps of the respective first and second coils, or between the start of the first coil and the start of the second coil, so that misconvergence of the electron beams is minimized. In order to compensate a resistance increase of the vertical deflection coils when temperature thereof rises, a temperature compensation circuit is further connected in series to the vertical deflection coils.

Other objects and further features of the present invention will be apparent from the following detailed description with respect to preferred embodiments of the invention when read in conjunction with the accompanying drawings.

DETAILED DESCRIPTION OF THE PREFERRED EMBODIMENT

Figure 1:
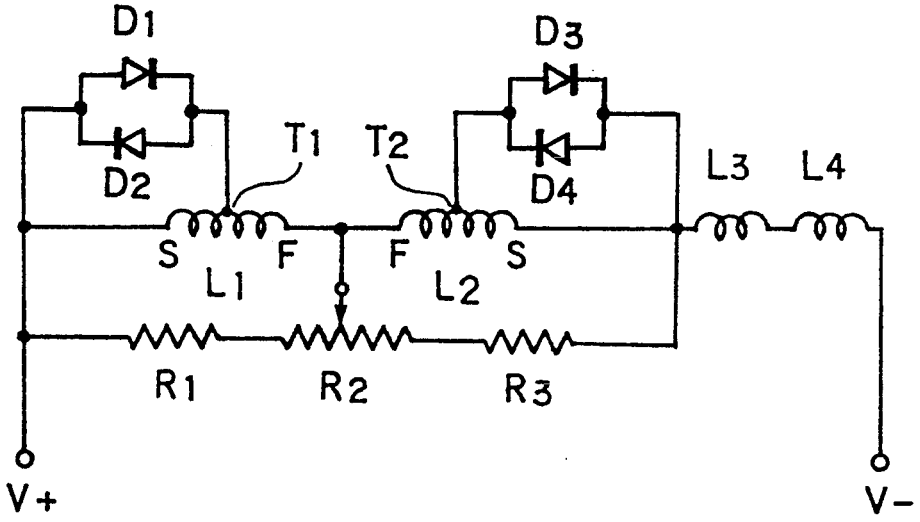
FIG. 1 shows a deflection yoke according to a first embodiment of the present invention.

Deflection yoke according to the present invention will be described in detail with reference to the accompanying drawings, in which same reference numerals and symbols are used to denote like or equivalent elements and detailed explanation of such elements are omitted for simplicity.

FIG. 1 shows a deflection yoke according to a first embodiment of the present invention, in which saddle-type horizontal deflection coils, which are similar to the conventional ones hitherto used, are applied. Therefore neither a description nor an illustration is provided for this kind of coils.

Two taps T1, T2, are provided at respective intervening points of the windings in a pair of saddle-type vertical deflection coils L1, L2 connected in series. h diode block consisting of diodes D1, D2 connected in parallel and with the polarity reversed and a coil L1 is connected in parallel between the tap T1 and the winding start S of the coil L1. Furthermore, a diode block composed of diodes D3, D4 connected in parallel and with the polarity reversed and a coil L2 is connected in parallel between the tap T2 and the winding start S of the coil L2.

Figure 7:
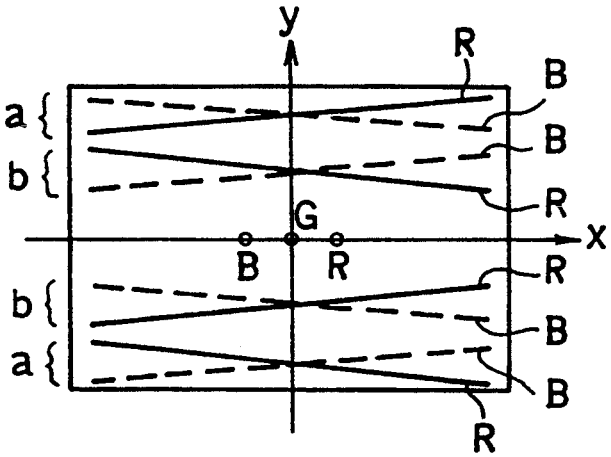
FIG. 7 explains a more complicated cross misconvergence.

Selected diodes D1–D4 are characterized in that the diode is turned on at a position in about the middle region (b) of the screen, as shown in FIG. 7, where the vertical deflection angle is located.

L3, L4 represent coma-correction coils as before; R1, R3 represent fixed resistors; and R2 represents a variable resistor.

Figure 5:
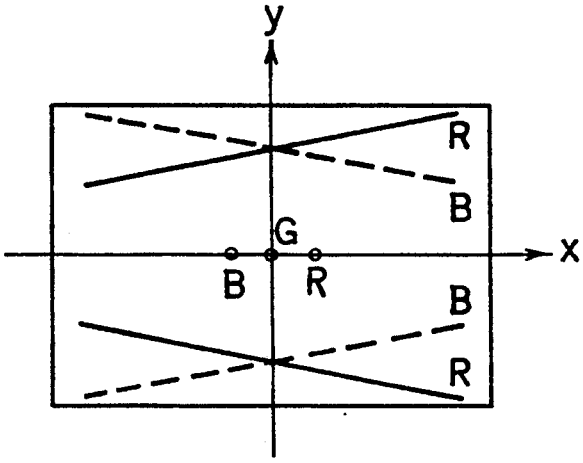
FIG. 5 explains a cross misconvergence.
Figure 6:
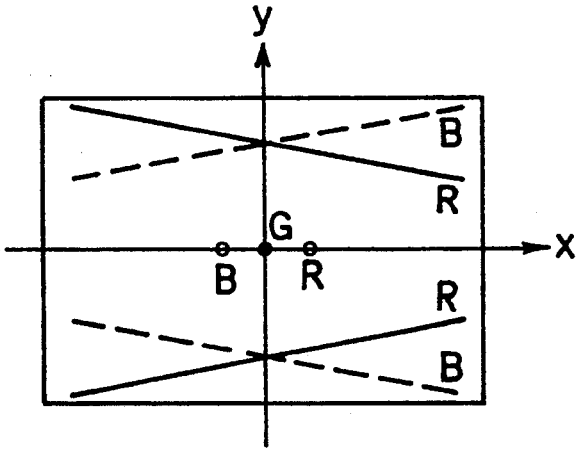
FIG. 6 explains another cross misconvergence.

Now, a function of this yoke is explained. Vertical deflection current generated from a vertical deflection driving circuit (not shown), is fed to terminals V+ and V− of the vertical deflection yoke. While the vertical deflection angle remains in the section between the 0° position (on the X-axis of the screen in FIGS. 5–7) and the turn-on position of the diodes D1–D4, in about the middle region (b) of the screen, equal amounts of vertical deflection current flow in the selection between the winding start S (winding finish F) of the saddle-type vertical deflection coil L1 and the tap T1, and in the section between the winding start S (winding finish F) of the vertical deflection coil L2 and the tap T2. At this time, the coils are conditioned in advance so that the magnetic field distribution formed by these coils provides optimum minimum) cross misconvergence in about the middle region (b) of the screen. Next, in the section where the vertical deflection angle is larger, the diodes D1–D4 are turned on, and the angle reaches the peripheral region (a) of the screen, the increase of the vertical deflection current between the winding start S and the tap is suppressed because the current is shunted to the diode block, causing the magnetomotive force in that section to be suppressed. Consequently, the magnetic field distribution formed after the diodes D1–D4 are turned on is shifted toward the pincushion type magnetic field distribution, compared with the magnetic field distribution which has been formed prior to the diodes being turned on. Thus, the present embodiment of the invention can correct the magnetic field distribution which had tended to shift toward the barrel-type magnetic field distribution in the peripheral region (a) of the screen when conventional devices were used, and suppresses generation of an inverted pattern.

The position where the diodes are turned on is adjusted within the range of about the middle region (b) of the screen so that generation of the inverted pattern is minimized.

Figure 2:
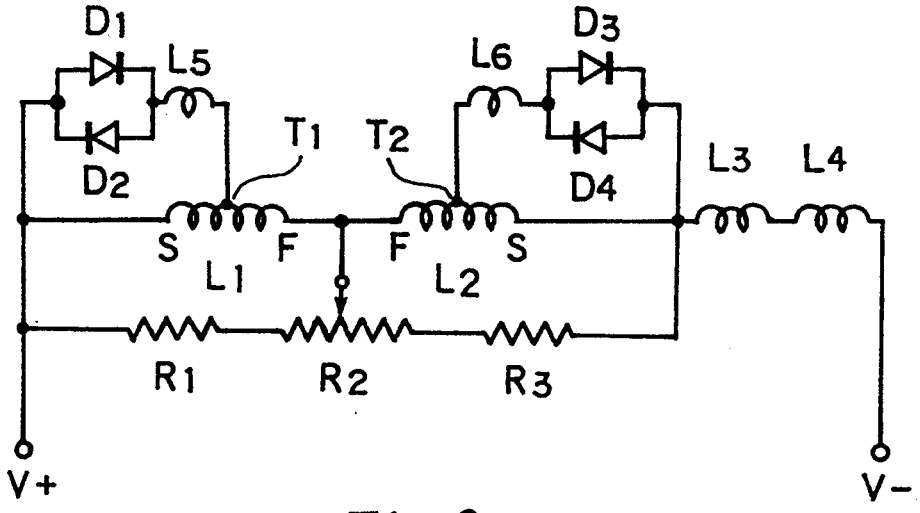
FIG. 2 shows a deflection yoke according to a second embodiment of the present invention.

FIG. 2 shows a deflection yoke according to a second embodiment of the present invention. This embodiment is realized by connecting new quadruple coma-correction coils L5, L6 to each diode block in the first embodiment in series. The coma-correction coils L5, L6 are fitted to the position having been occupied by the coma-correction coils L3, L4 behind the horizontal- and vertical-deflection coils close to the electron guns.

Figure 3:
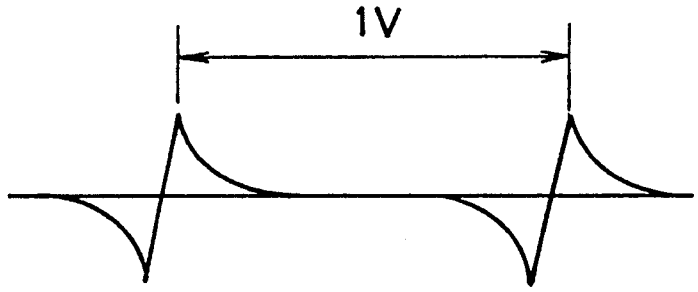
FIG. 3 shows a waveform of current flowing through a coma-correction coil.

FIG. 3 shows a waveform of current flowing through a coma-correction coil, wherein 1 V designates one vertical scanning period.

The current shunted from the vertical deflection current flowing through the vertical deflection coil, flows through the coma-correction coils L5, L6 with the waveform shown in FIG. 3 having the diodes D1–D4 operating on-off as explained in the first embodiment. These coma-correction coils L5, L6 are formed so that the generated magnetic field has the same polarity as the vertical deflection field. Then, the center of the vertical deflection magnetic field of the deflection yoke is shifted to a side of the electron gun after the diodes D1–D4 are turned on because the coma-correction coils L5, L6 are located behind the horizontal- and vertical-deflection coils L1, L2 close to the electron guns. At this time, the distribution of the horizontal deflection magnetic field does not change although that of the vertical-deflection magnetic field is shifted relatively, and in this way the cross misconvergence changes toward the normal cross direction.

Therefore, in the second embodiment, the correction effect for the inverted pattern is more enhanced by the shift of the center of the vertical deflection magnetic field in addition to the change of the vertical magnetic field distribution the change that the pincushion type magnetic field distribution is strengthened in the peripheral region of the screen as explained in the first embodiment.

Furthermore, the second embodiment shows the effect leading to a reduction of the phase lag of the current flowing through the vertical deflection coil against a sudden change of the vertical deflection current immediately after the vertical flyback interval, and therefore it is especially effective when used in a device in which the interval from the vertical flyback interval to the display duration is short as in computer displays. Furthermore, the second embodiment can correct the tracking of a coma error arising in the vertical direction because a current flows through the coma-correction coils L5, L6 from the moment the vertical deflection angle appears in the middle of the screen.

It may also be possible to fit fixed or variable resistors in place of coma-correction coils L5, L6, and thereby adjust the amount of current to be shunted to the diode block so as to control the correction effect on the inverted pattern.

Figure 4:
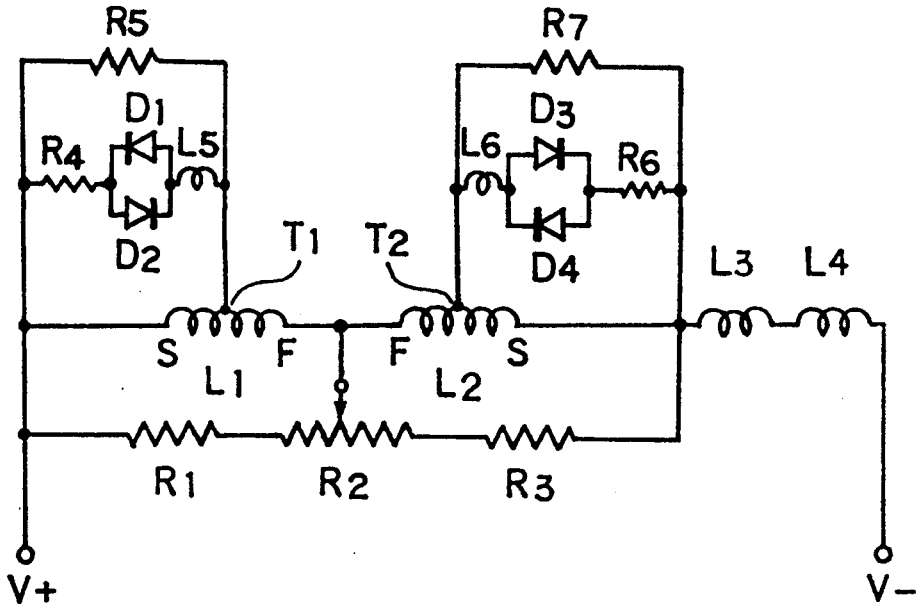
FIG. 4 shows a deflection yoke according to a third embodiment of the present invention.

FIG. 4 shows a deflection yoke according to a third embodiment of the present invention. This embodiment is constituted by adding the following features to the second embodiment, the diode blocks are each connected with resistors, R4 and R6 in series, and a resistor R5 is connected between the winding start S of the coil L1 and the tap T1 while a resistor R7 is connected between the winding start S of the coil L2 and the tap T2. In the third embodiment, the resistors R4–R7 (especially resistors R4, R6) can adjust the amount of the current shunted to the corresponding diode blocks, and thereby allow fine control of the inverted pattern. In addition, the resistors R4–R7 can be variable.

Figure 8:
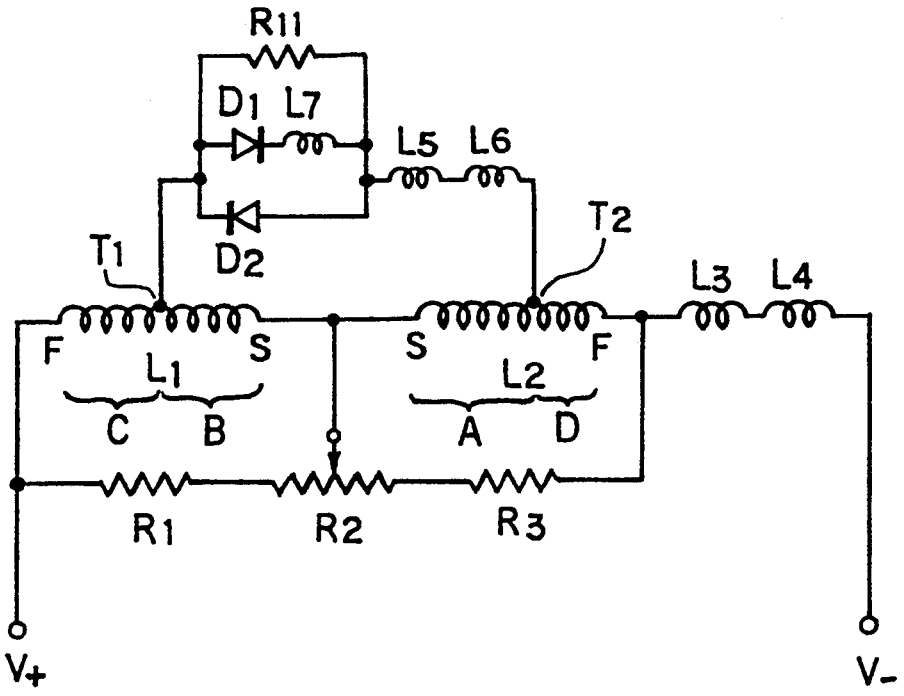
FIG. 8 shows a deflection yoke according to a fourth embodiment of the present invention.

FIG. 8 shows a deflection yoke according to a fourth embodiment of the present invention. In this embodiment, each winding start S of the vertical deflection coils L1, L2 is connected to the other so as to have the same potential. Furthermore, a series circuit of a diode block and quadruple coma-correction coils L5, L6, which diode block is composed of diodes D1, D2 connected in parallel and mutually reversed in polarity, is connected between the taps T1, T2 and in parallel with the coils L1, L2. The resistor R11 and the coil L7 are elements used to adjust the circuit. The coma-correction coils L5, L6 are fitted on the position where the hitherto coma-correction coils L3, L4 are fitted behind the horizontal- and vertical-deflection coils close to the electron guns. The whole of the vertical-deflection coils L1, L2 is divided into four winding blocks A–D for the sake of convenience using the winding starts, taps, and winding finishes as boundaries.

The function of the deflection yoke in the fourth embodiment is explained next. It is almost the same as in the second embodiment. While the vertical deflection angle remains in the section between the 0° position (on the X-axis of the screen in FIGS. 5–7) and the turn-on position of the diodes D1, D2 in about the middle region (b) on the screen, equal amounts of the vertical deflection current flow in the section between the winding start S (winding finish F) of the saddle-type vertical deflection coil L1 and the tap T1, and in the section between the winding start S (winding finish F) of the saddle-type vertical deflection coil L2 and the tap T2. At this time, the coils are conditioned in advance so that the magnetic field distribution formed by these coils creates an optimum (minimum) cross misconvergence in about the middle region (b) of the screen. Next, in the section where the vertical deflection angle becomes larger, the diodes D1, D2 are turned on, and the angle reaches the peripheral region (a) of the screen, the increase of the vertical deflection current between the winding start and the tap is suppressed (because the current is shunted to the diode block), causing the suppression of the magneto-motive force in that section. Consequently, the magnetic field distribution formed after the diodes D1, D2 are turned on shifts toward the pincushion type magnetic field distribution, compared with the magnetic field distribution which had been formed prior to the turning on of the diodes. Thus the present embodiment of the invention can correct the magnetic field distribution which had tended to shift toward the barrel-type magnetic field distribution in the peripheral region (a) of the screen when conventional devices were used, and suppress generation of an inverted pattern.

Figure 9:
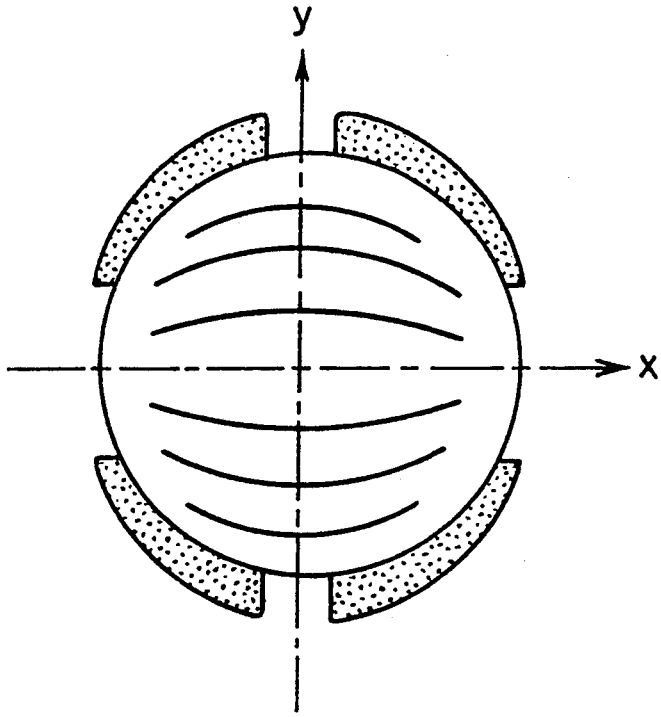
FIGS. 9(*a*) and 9(*b*) show a magnetic field distribution of the fourth embodiment.
Figure 9:
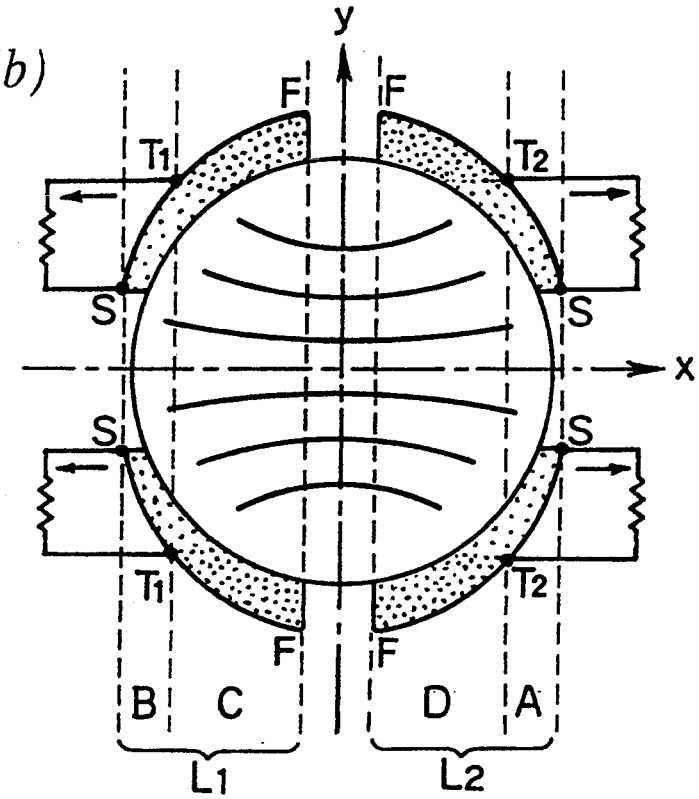

FIGS. 9(*a*) and 9(*b*) show a magnetic field distribution of the fourth embodiment. In detail, FIGS. 9(*a*) and 9(*b*) show schematically a cross-sectional view of a pair of vertical deflection coils L1 and L2, the coil L1 at the left and the coil L2 at the right of FIGS. 9(*a*) and 9(*b*) respectively, distribution of dots in a cross-section (shown as a sector in the figures) of the coils represents a relative current density within the coils, each of the vertical deflection coils L1 and L2 is wound in a form of single coil but is shown only in a pair of top and bottom portions thereof. Further in FIGS. 9(*a*) and 9(*b*), "S" denotes a start of each of coil winding of the coils L1 and L2, "F" a finish of the same and "T1, T2" a tap of the same, of which, the same symbols mean physically a single part of respective coils despite such symbols appear in both the top and bottom halves of respective FIGS. 9(*a*) and 9(*b*).

FIG. 9(*a*) shows when the diodes D1 and D2 connected between the taps T1 and T2 are turned off, and FIG. 9(*b*) shows when the diodes D1 and D2 are turned on showing that the diode block corrects the tendency of the magnetic field distribution to shift to the barrel type in the peripheral region of the screen.

The position where the diodes are turned on is adjusted within the middle region of a screen.

Then, the shunted current from the vertical deflection current flowing through the vertical deflection coils L1, L2 is made to flow through the coma-correction coils L5, L6 in a waveform shown in FIG. 3 by the on-off action of the diodes D1, D2. These coma-correction coils L5, L6 are formed so that the generated magnetic field has the same polarity as the vertical deflection magnetic field. Then, the center of the vertical deflection magnetic field of the deflection yoke is shifted to a side of the electron gun after the diodes D1, D2 are turned on because the coma-correction coils L5, L6 are located behind the horizontal and vertical deflection coils L1, L2 close to the electron guns. At this time, the distribution of the horizontal-deflection magnetic field does not change although that of the vertical-deflection magnetic field is relatively shifted, which causes the cross misconvergence to move toward the normal cross direction.

Consequently, in the fourth embodiment as in the second embodiment, (1) the correction effect for inverted pattern is further strengthened by the shift of the center of the vertical deflection magnetic field in addition to the change of the vertical magnetic field distribution i.e. the pincushion type magnetic distribution is further strengthened in the peripheral region of the screen.

(2) The present embodiment reduces the phase lag of the current flowing in the vertical deflection coil against a sudden change in the vertical deflection current immediately after the vertical-flyback line period, and therefore it is particularly effective when used in a device which has a short transient time from the vertical flyback interval to the display duration as in computer displays.

(3) Since a current starts to flow in the coma-correction coils L5, L6 at the moment the vertical deflection angle reaches the middle region of the screen, the tracking of the coma error appearing in the vertical direction can be corrected.

Figure 10:
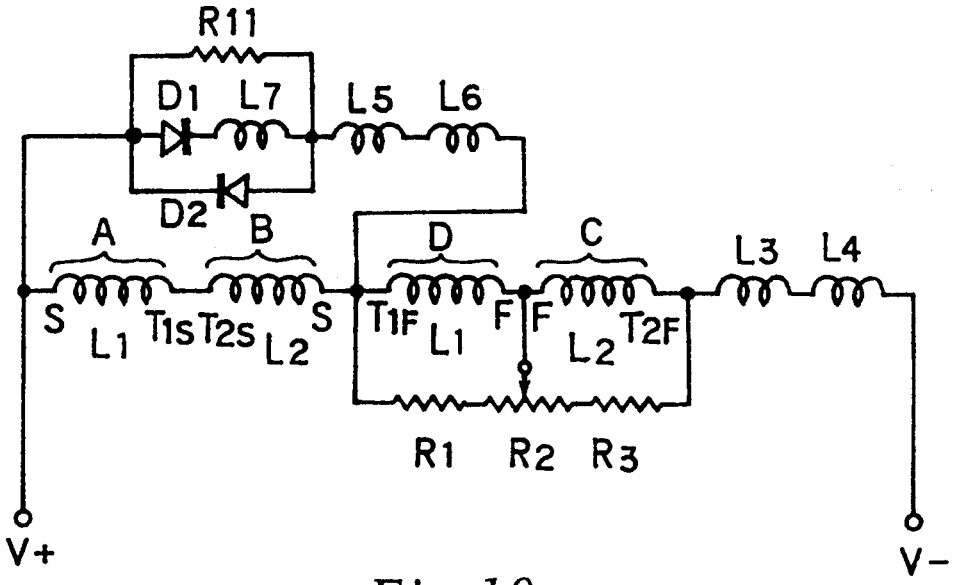
FIG. 10 shows a deflection yoke according to a fifth embodiment of the present invention.
Figure 11:
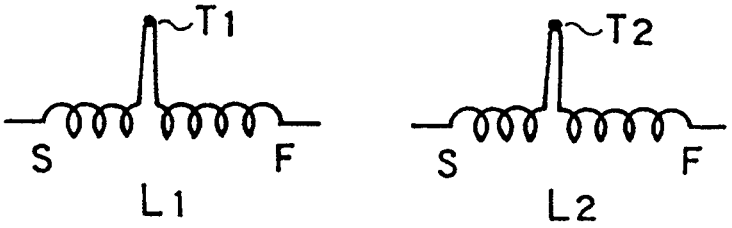
FIGS. 11(*a*) and 11(*b*) explain taps and their connections.
Figure 11:
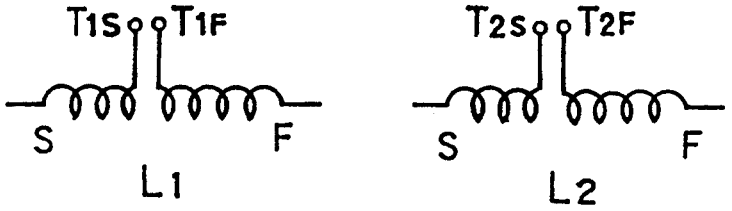

Next, a fifth embodiment is shown in FIG. 10, and FIGS. 11 (*a*) and 11(*b*) explain taps provided in the respective vertical deflection coils L1, L2 and their connections. In this embodiment, the taps T1, T2 [see FIG. 11(*a*)] in the respective vertical deflection coils L1, L2 are each split into the winding start side tap and the winding finish side tap, T1S, T1F; T2S, T2F [see FIG. 11(*b*)], respectively. Namely, a pair of saddle-type vertical deflection coils L1, L2 are each severed at one point in the middle of winding and the winding start sides of these severed points T1, T2 are denoted as T1S, T2S, respectively, while the winding finish sides of these severed points are denoted as T1F, T2F. Then, the winding start side tap T1S of the coil L1 and the winding start side tap T2 of the coil L2 are connected so as to have the same potential; the winding start S of the coil L2 and the winding finish side tap T1F of the coil L1 are connected so as to have the same potential, the winding finish F of the coil b1 and the winding finish F of the coil L2 are connected so as to have the same potential. Moreover, a diode block and coma-correction coils L5, L6 which are the same as those in the fourth embodiment are connected in series between the winding starts S, S of a pair of vertical deflection coils L1 and L2.

The winding blocks A–D divided in accordance with the fourth embodiment are arranged along the direction of current flow in the order shown in FIG. 10. For example, while the winding block A designates the section in which the current flows from the winding start S to the tap in the fourth embodiment, the corresponding section in the fifth embodiment is that from the winding start S of the coil L1 to T1S.

Thus, the fifth embodiment is realized by changing the state of the wire connection of winding blocks A–D in the fourth embodiment, and these two embodiments have the same functions and effects.

Both the fourth and fifth embodiments allow the series connection of a resistor to the diode block as in the third embodiment. In that case, the coma-correction coils L5, L6 can be omitted.

The DC resistance of the coils L1, L2 significantly increases in some cases where the heat generated by the main body of the deflection yoke is large (in high frequency operation) or the deflection yoke is used in an environment where a temperature of the surrounding such as the inside of the display device is high. In this case, the DC resistance between the winding start and the tap increases markedly since both these members form parts of the coils L1, L2. As a result, in the first to fifth embodiments, the shunt current ratio of the parallel circuit composed of the deflection coil circuit between each winding start of the coils L1, L2 and the corresponding tap and the diode block circuit may be deviated from the value preset to give the optimum convergence, because of the effect of the heat.

Figure 12:
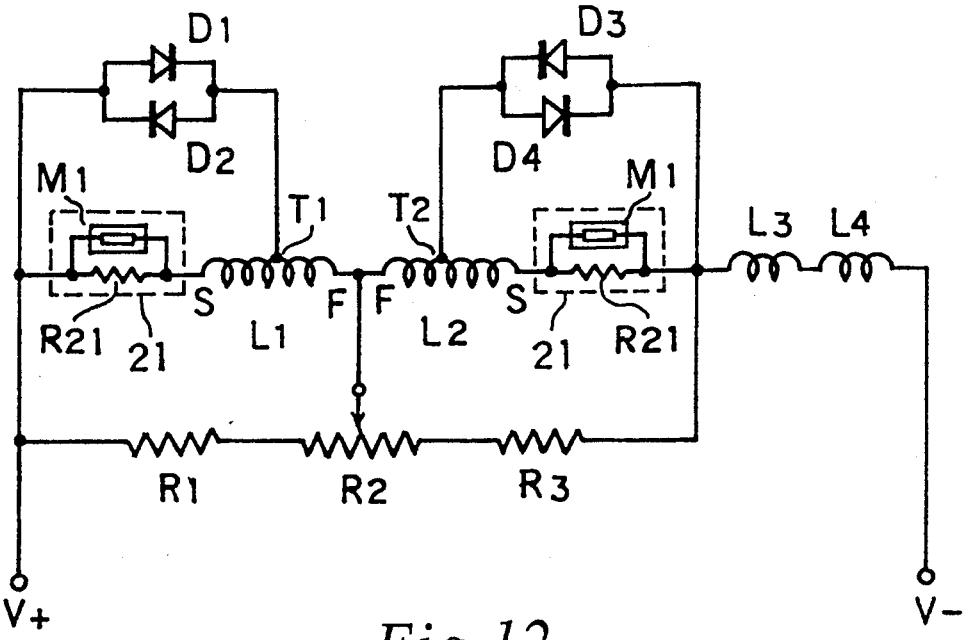
FIG. 12 shows a deflection yoke according to a sixth embodiment of the present invention.
Figure 13:
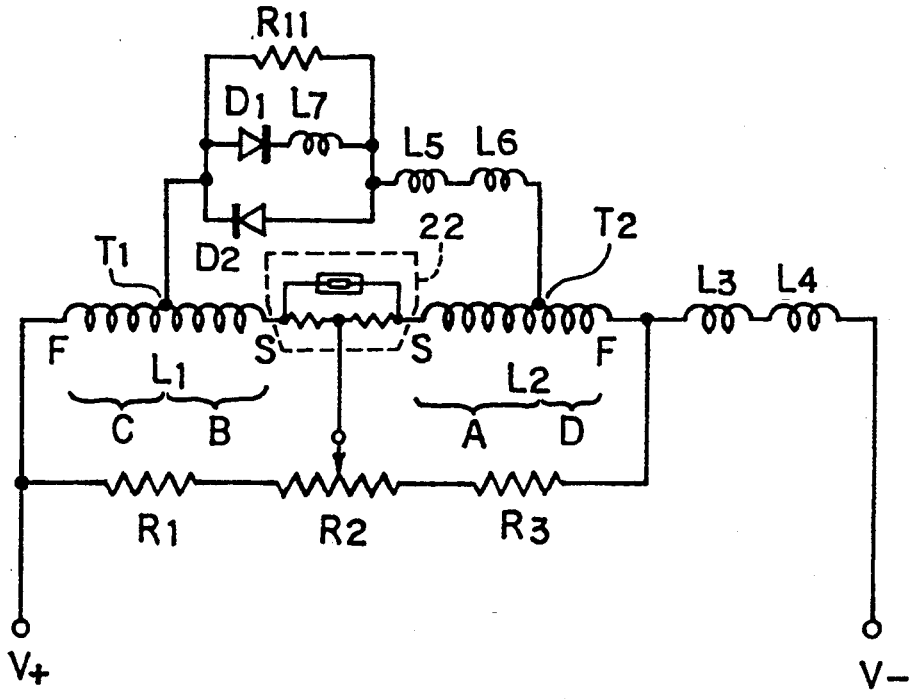
FIG. 13 shows a deflection yoke according to a seventh embodiment of the present invention.
Figure 14:
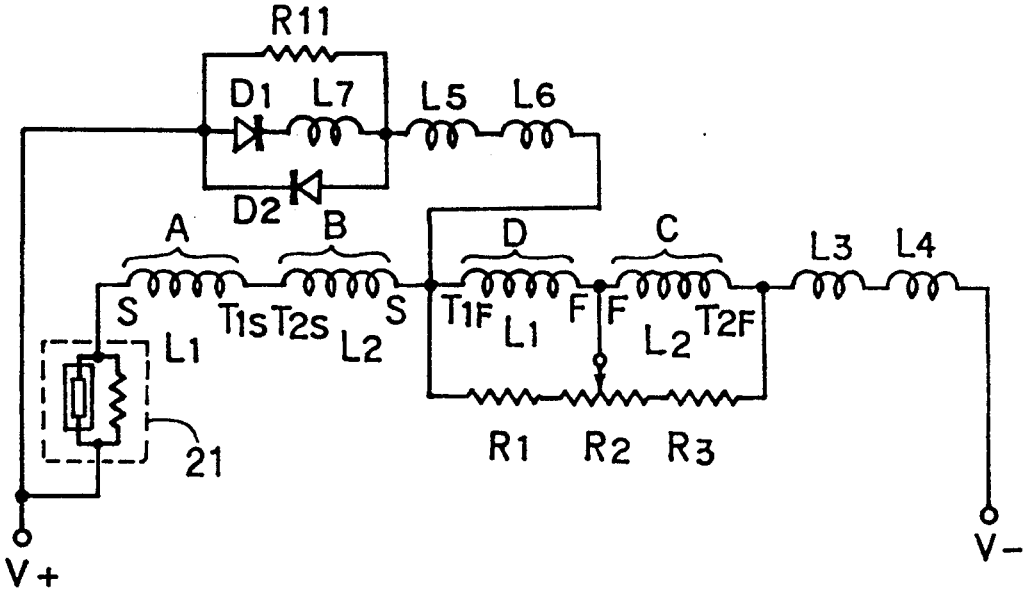
FIG. 14 shows a deflection yoke according to a eighth embodiment of the present invention.

FIG. 12 shows a deflection yoke according to a sixth embodiment of the present invention. FIG. 13 shows a deflection yoke according to a seventh embodiment of the present invention. FIG. 14 shows a deflection yoke according to a eighth embodiment of the present invention.

In order to overcome the aforementioned heat problem, temperature compensation circuits 21, 22 are provided in the deflection yoke of the sixth to the eighth embodiments shown in FIGS. 12–14. The temperature compensation circuits 21, 22 are inserted in series with the coils L1 and L2, and a DC resistance of the temperature compensation circuits 21, 22 decreases as the temperature rise so that the increase in the DC resistance developed in the coils L1 and L2 (between their winding start and the tap) is cancelled out. The temperature compensation circuit has such a DC resistance characteristic that its resistance is reduced by an amount equal to the increase in the DC resistance in the vertical deflection coil circuit in order to maintain the shunt ratio of the above parallel circuit at all times. Actuality, the temperature compensation circuit is made up of a thermistor M1 with a negative temperature coefficient and a fixed resistor R21, as shown in FIG. 12.

The sixth embodiment shown in FIG. 12 is constituted by adding a temperature compensation circuit 21 to the first embodiment shown in FIG. 1. The seventh embodiment shown in FIG. 13 is constituted by adding a temperature compensation circuit 22 to the fourth embodiment shown in FIG. 8. The eighth embodiment shown in FIG. 14 is constituted by adding a temperature compensation circuit 21 to the fifth embodiment shown in FIG. 10.

The temperature compensation circuit can be placed anywhere in the vertical deflection coil circuit of the parallel circuit consisting of a winding section (coil circuit) formed between the winding start of the coil L1 (L2) and tap T1 (T2), and the diode block. Taking FIG. 14 as an example, the temperature compensation circuit may be placed between T1S and T2S, or otherwise on the winding start side of the coil L2.

Although the above embodiments use one pair of saddle-type vertical deflection coils, various pairs of coils may be used. In this case, it is only necessary to fit a diode block in at least one of the various pairs. Furthermore, a zener diodes connected in series with the polarity reversed may also be used.

EFFECTS OF THE INVENTION

As described above, the deflection yoke according to the present invention provides a method which allows the inverted pattern of cross misconvergence to be easily corrected, the dissolution of distortions in the upper and lower rasters of the screen and convergence to be made compatible, and the quality of convergence to be greatly improved.

Furthermore, since this deflection yoke allows the inverted pattern to be easily corrected by adjusting the turn-on position of the diode block, the labor required in the conventional process where the inverted pattern is corrected by manually adding magnetic pieces or the like to each deflection yoke is drastically reduced. Consequently, the deflection yoke in accordance with the present invention can improve working efficiency and enhance productively.

In addition, a deflection yoke provided with a temperature compensation circuit can cancel the amount of any change, resulting from a temperature change, in the DC resistance of the section in parallel with the diode block of the vertical deflection coil, and hence it can maintain the optimum value of the shunt ratio of the parallel section at all times, and optimum convergence to be obtained even when during a high frequency operation under high temperature condition.

What is claimed is:

1. Deflection yoke of self-convergence system for deflecting electron beams of a color picture tube, having a pair of saddle-type horizontal deflection coils and a pair of saddle-type vertical deflection coils connected in series each other, a winding of each of saddle-type vertical deflecting coils of said pair having a start, a finish and a tap provided between said start and said finish, said deflection yoke further comprising diode means composed of diodes connected in parallel and reversed polarity each other, said diode means connected between said start and said tap.

2. Deflection yoke as claimed in claim 1, wherein said diodes are zener diodes.

3. A deflection yoke as claimed in claim 1, wherein said deflection yoke further comprises one of resistor means and coma-correction means being connected in series with said diode means.

4. Deflection yoke of self-convergence system for deflecting electron beams of a color picture tube, having a pair of saddle-type horizontal deflection coils and saddle-type vertical deflection coil means comprised of first and second coils connected in series each other, each of said first and second coils having a start, a finish and a tap provided between said start and said finish, said deflection yoke further comprising diode means composed of diodes connected in parallel and reversed polarity each other, said diode means connected between said tap of said first coil and said tap of said second coil.

5. Deflection yoke as claimed in claim 4, wherein said diodes are zener diodes.

6. A deflection yoke as claimed in claim 4, wherein said deflection yoke further comprises one of resistor means and coma-correction means being connected in series with said diode means.

7. Deflection yoke of self-convergence system for deflecting electron beams of a color picture tube, having a pair of saddle-type horizontal deflection coils and saddle-type vertical deflection coil means comprised of first and second coils, each of said first and second coils having a start, a finish and tap means provided between said start and said finish, said tap means comprising a first tap and a second tap severed from each other so as to form, in said first and second coils respectively, a first coil section between said start and said first tap and a second coil section between said second tap and said finish, said first tap of said first coil being directly connected to said first tap of said second coil, said second tap of said first coil being directly connected to said start of said second coil, and said finish of said first coil being directly connected to said finish of said second coil, said deflection yoke further comprising diode means composed of diodes connected in parallel and reversed polarity each other, said diode means connected between said start of said first coil and said start of said second coil.

8. Deflection yoke as claimed in claim 7, wherein said diodes are zener diodes.

9. A deflection coil as claimed in claim 7, wherein said deflection yoke further comprises one of resistor means and coma-correction means being connected in series with said diode means.

10. A deflection yoke as claimed in claim 1, wherein said deflection yoke further comprises a temperature compensation circuit connected in series to each of said saddle-type vertical deflection coils, one end of said temperature compensation circuit is connected to said start, and another end of said temperature compensation circuit is connected to one end of said diode means, and wherein said temperature compensation circuit reduces a resistance thereof to compensate a resistance increase of said each of said saddle-type vertical deflection coils as temperature rises.

11. A deflection yoke as claimed in claim 4, wherein said deflection yoke further comprises a temperature compensation circuit connected between said start of said first coil and said start of said second coil, and wherein said temperature compensation circuit reduces a resistance thereof to compensate a resistance increase of said each of said saddle-type vertical deflection coils as temperature rises.

12. A deflection yoke as claimed in claim 7, wherein said deflection yoke further comprises a temperature compensation circuit connected between said start of said first coil and one end of said diode means, and wherein said temperature compensation circuit reduces a resistance thereof to compensate a resistance increase of said each of said saddle-type vertical deflection coils as temperature rises.

* * * * *